US006309211B1

(12) United States Patent
Dock et al.

(10) Patent No.: US 6,309,211 B1
(45) Date of Patent: Oct. 30, 2001

(54) PORT AIR CONVEYING SYSTEM FOR ROTARY KILN

(75) Inventors: Neil R. Dock, Selinsgrove; Edward T. Maciejewski, Catawissa, both of PA (US)

(73) Assignee: Suedala Industries, Inc., Waukesha, WI (US)

( * ) Notice: Subject to any disclaimer, the term of this patent is extended or adjusted under 35 U.S.C. 154(b) by 0 days.

(21) Appl. No.: 09/592,924

(22) Filed: Jun. 13, 2000

(51) Int. Cl.[7] ..... F27B 7/28
(52) U.S. Cl. ..... 432/119
(58) Field of Search ..... 432/119, 103

(56) References Cited

U.S. PATENT DOCUMENTS

| | | | | |
|---|---|---|---|---|
| 1,374,203 | * | 4/1921 | Harrison | 432/119 |
| 1,655,566 | * | 1/1928 | Reintjes | 432/119 |
| 1,936,635 | * | 11/1933 | Lee | 432/119 |
| 2,230,142 | * | 1/1941 | Longacre | 432/119 |
| 3,346,248 | * | 10/1967 | Martinet et al. | 432/119 |
| 3,882,801 | * | 5/1975 | Bolle | 432/119 |
| 3,946,949 | | 3/1976 | Rossi | 239/600 |
| 4,155,704 | | 5/1979 | Kulabukhov et al. | 432/105 |
| 4,273,314 | | 6/1981 | Keran et al. | 266/145 |
| 4,340,360 | * | 7/1982 | Hoedl et al. | 432/119 |
| 4,354,829 | | 10/1982 | Estes | 432/117 |
| 5,299,933 | | 4/1994 | Mosci | 432/103 |
| 5,330,351 | | 7/1994 | Ransom, Jr. et al. | 432/103 |
| 5,460,518 | | 10/1995 | Mosci | 432/103 |
| 5,572,938 | | 11/1996 | Leger | 110/346 |
| 5,616,023 | | 4/1997 | Mosci | 432/103 |
| 5,623,883 | | 4/1997 | Davidson et al. | 110/226 |
| 5,632,616 | | 5/1997 | Tutt et al. | 432/105 |
| 5,695,329 | | 12/1997 | Orcutt | 432/103 |
| 5,702,247 | | 12/1997 | Schoof | 432/103 |
| 5,704,781 | | 1/1998 | Swoboda | 432/119 |
| 5,704,782 | | 1/1998 | Schulze et al. | 432/119 |
| 5,873,714 | | 2/1999 | Mosci | 432/119 |
| 6,116,896 | | 11/2000 | Joshi et al. | 432/117 |

OTHER PUBLICATIONS

Suspended Refractory Walls and Arches, Bigelow–Liptak Corporation, Bulletin 75–110MRH.

* cited by examiner

*Primary Examiner*—Jiping Lu
(74) *Attorney, Agent, or Firm*—Andrus, Sceales, Starke & Sawall, LLP

(57) ABSTRACT

A rotary kiln includes a novel air conveying system for delivering a supply of port air beneath the material bed of feed stock passing through the interior of the kiln. The air conveying system includes an air inlet port disposed in the shell of the kiln, a main air conveying channel which communicates with the air inlet port, and a plurality of air vent channels communicating with the main air conveying channel and the interior chamber of the kiln. The main air conveying channel is formed integrally in the refractory bricks which line the inner surface of the kiln shell and extends longitudinally and parallel to the rotary axis of the kiln. The air vent channels extend through the refractory bricks substantially radially with respect to the rotary axis of the kiln.

23 Claims, 9 Drawing Sheets

18
46
52
62
54
50
46
B
60
50
A

PORT AIR CONVEYING SYSTEM FOR ROTARY KILN

BACKGROUND OF THE INVENTION

The present invention relates to rotary kilns, and more particularly to an air conveying system for the introduction of port air into the bed of material being processed in a rotary kiln.

In currently utilized ported rotary kilns, the rotary kiln includes a series of openings extending through the refractory lining and outer shell to allow air to enter into the kiln to enhance the process occurring within the kiln. Typically, the series of openings each include a metal grid that is flush mounted with the inner surface of the kiln refractory lining, as is shown in U.S. Pat. No. 5,248,330. Although this type of grid is effective to prevent large particles of material from entering into the duct work introducing the air, the grid is directly exposed to both the high temperature and the hot tumbling material within the open enclosure of the rotating kiln. The high temperature and the physical contact with the tumbling material causes wear to the grid, which must eventually be replaced.

Additionally, the grid size of the flush mounted grid of the prior art allows small particles of material to enter into the duct work. These small particles can eventually plug the duct work causing a reduction or total loss of port air flow. If for any reason there is a loss of port air, the metal grid will quickly melt due to contact with the hot tumbling material within the kiln.

SUMMARY OF THE INVENTION

The rotary kiln of the present invention includes a novel air conveying system for delivering a supply of port air beneath the material bed of feed stock passing through the interior of the kiln. This new air delivery system eliminates the prior art method of using flush mounted grids with ported air and the attendant problems associated with such grids.

The air conveying system includes an air inlet port disposed in the shell of the kiln, a main air conveying channel which communicates with the air inlet port, and at least one air vent channel communicating with the main air conveying channel and the interior chamber of the kiln. The main air conveying channel is formed integrally in the refractory material which lines the inner surface of the kiln shell and extends longitudinally and parallel to the rotary axis of the kiln. The air vent channel extends through the refractory material substantially radially with respect to the rotary axis of the kiln.

The refractory material includes a plurality of new specially shaped bricks, referred to herein as refractory channel port bricks (RCP bricks), disposed longitudinally and circumferentially adjacent one another in a staggered arrangement, and the main air conveying channel and a plurality of air vent channels are formed integrally therein. More specifically, a main opening is forming through each brick and extends from the front face to the rear face thereof. When the bricks are assembled in place, the main air openings in adjacent bricks are aligned and form the main air conveying channel. Preferably, the main air opening is formed in the bottom face of each brick and is substantially U-shaped in cross section so that the main air conveying channel extends along the inner surface of the kiln shell.

An air vent channel is also formed in each brick and extends from the main air conveying channel to its top face. Preferably, each air vent channel is comprised of a top air vent passage formed as a recess in the front face of each brick and extending downwardly from the top face to a lower end located between the top face and the bottom face, and a bottom air vent passage formed as a recess in the rear face of each brick and extending upwardly from the bottom face to an upper end located between the bottom face and the top face. Thus, when one brick is positioned so that its front face abuts against the rear face of another brick lining the kiln, not only are the main air openings of each brick aligned to form the main air conveying channel, but also the top vent passage of one brick is aligned with the bottom vent passage of the other brick to form the desired air vent channel into the interior of the kiln.

Preferably, the air vent channel has a double dogleg configuration to avoid the creation of a direct line of sight path through which heat would be transferred from the kiln interior directly to the kiln shell via radiation. However, each air vent channel could be straight depending on kiln design and/or feed stock being processed. Also, although the top and bottom air vent passages are preferably rectangular-shaped recesses in the front and rear faces of each brick, they may be formed directly through the interior of each brick, for example by boring or casting a hole therein.

Another feature of the invention is the use of key blocks attached to the kiln shell to prevent the refractory bricks from rotating within the shell. These key blocks thus maintain alignment of the air inlet ports in the kiln shell with the main air conveying channel formed in the bricks.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

It should be noted that although the present invention will hereinafter be described in connection with processing of flyash and sewage sludge to form a lightweight aggregate product, it should not be considered limited to use in such a process. In fact, the rotary kiln, refractory materials and air delivery system hereinafter to be described may be utilized with any process in which a rotary kiln may conventionally be employed. For example, another use would be iron ore pellet induration.

Figure 1:
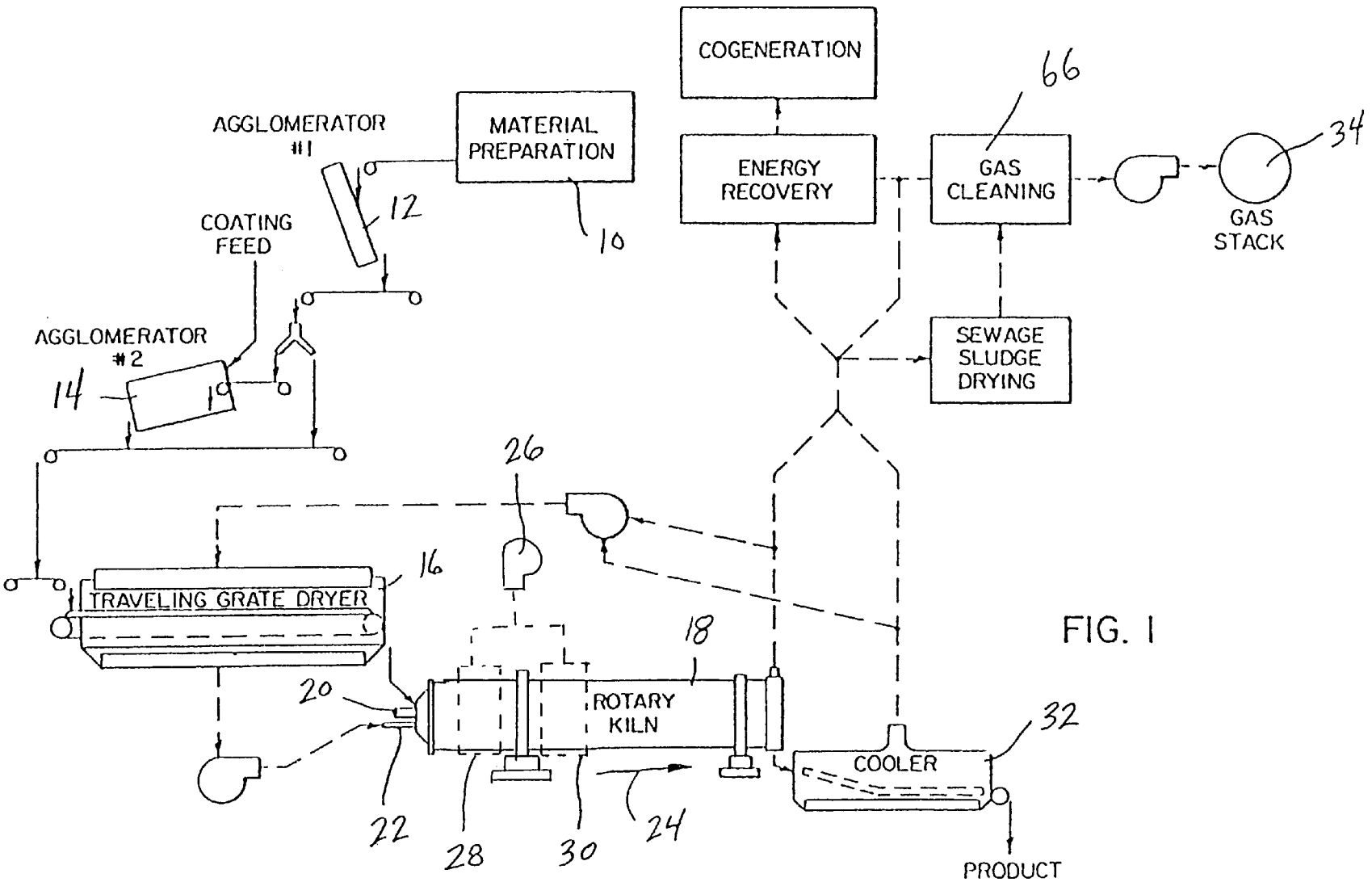
FIG. 1 is a schematic illustration of a process for forming lightweight aggregate from flyash and sewage sludge which includes a rotary kiln having the ability to introduce port air using the novel air conveying system of the present invention.

Referring first to FIG. 1, flyash and sewage sludge are initially mixed in a material preparation area 10 which may include batch or continuous mixing. The flyash and sewage sludge are mixed in a proportion of about 35%–99% flyash by dry weight to about 1%–65% sewage sludge by dry weight. For proper agglomeration, it may be necessary and desirable to add a binder, such as bentonite, to assist in formation of the mixed particles. Such a binder should not exceed about 20% by total dry weight of the resulting mixture and preferably does not exceed about 4%.

The blended flyash and sewage sludge mixture is fed to a first agglomerator 12 which agglomerates the mixture into small pellets in the range of about ⅛ to ¾ inches in diameter. The green pellets produced in the first agglomerator 12 are fed to a second agglomerator 14 in which the pellets may be coated to prevent the green pellets from sticking to each other during heat treatment in the rotary kiln. The preferable coating is a low loss-on-ignition flyash. Alternatively, dolomite, limestone, portland cement or other material may be used as a coating.

Although the green pellets leaving the second agglomerator 14 are formed from a combination of flyash and sewage sludge, it should be understood that other types of fuel-rich waste products, such as paper mill sludge, could be substituted for the sewage sludge or added into the mixture while operating within the scope of the present invention. Paper mill sludge, like sewage sludge, contains a significant amount of organic material fuel and binds well with flyash.

Upon leaving the second agglomerator 14, the green pellets are dried on a traveling grate dryer 16. The green pellets are dried to a moisture content that is preferably below 5%. The dried pellets are then introduced as feed stock into a rotary kiln 18 constructed in accordance with the present invention. The dried pellets are fed into the same end of the rotary kiln 18 from which external fuel is introduced through a burner 20 and through which air is introduced through an air lance 22. The pellets slowly travel through the inclined rotary kiln 18 in the same direction (i.e. co-currently) with the direction of flow of hot gases through the kiln, as illustrated by arrow 24.

The rotary kiln 18 of the present invention includes a port air fan 26 that introduces port air beneath the accumulated pelletized feed stock in a first port air zone 28 and a second port air zone 30. The specific process occurring within the first port air zone 28 and the second port air zone 30 will be described in greater detail below. It should be noted, however, that dual air zones may not necessarily be used in all applications. Thus, for some end uses only a single continuous air port zone might be utilized, while for other end use, more port zones might be utilized.

The product leaving the rotary kiln 18 is fed into a cooler 32, which can be water or air cooled, to bring the product temperature down to a temperature where it can be further handled and stockpiled. The heat from the cooler 32 may be recovered and used for various purposes including drying the green pellets in the traveling grate dryer 16. Unused gases will pass to a gas cleanup and exit the gas stack 34.

Figure 2:
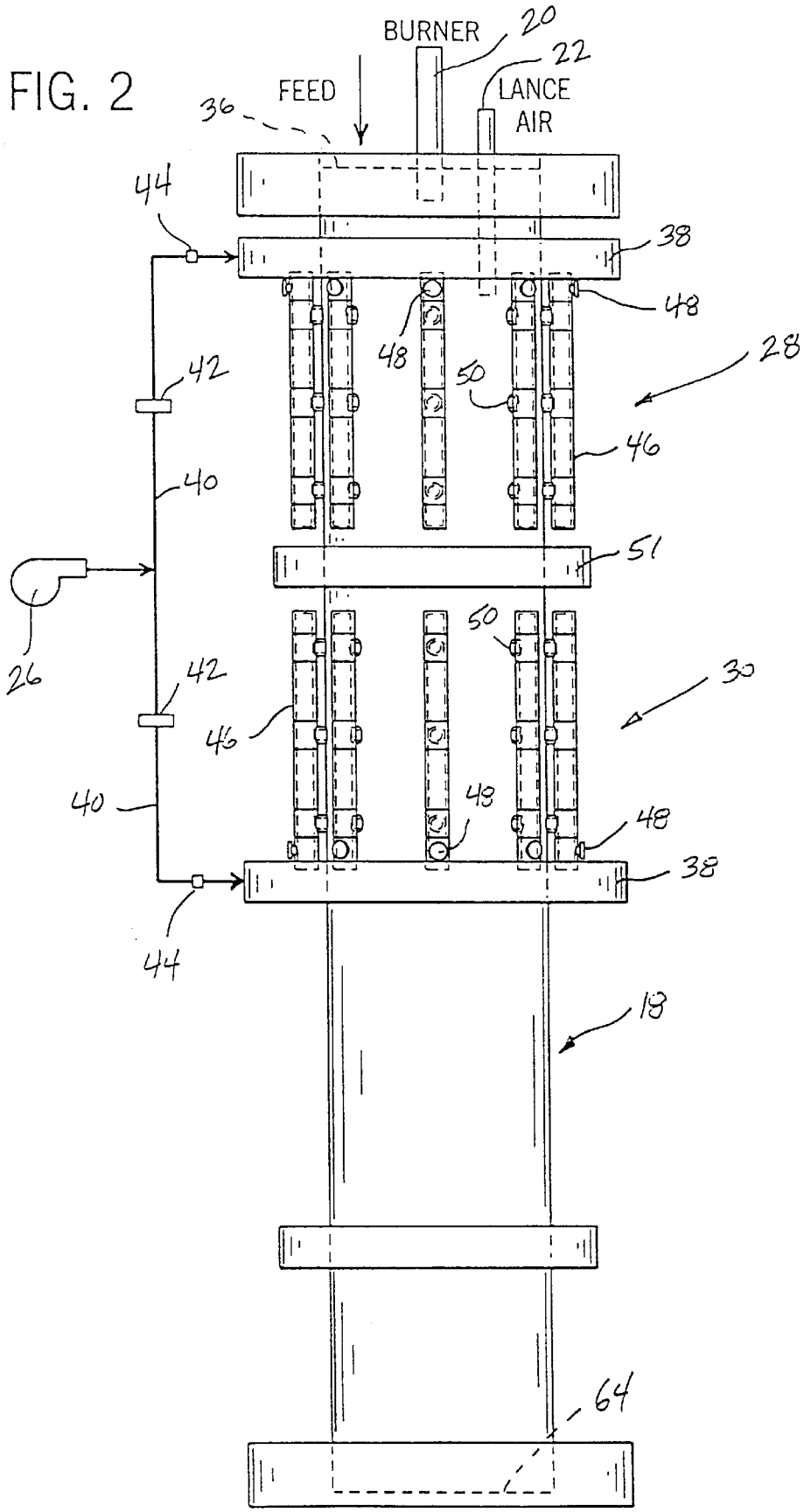
FIG. 2 is a schematic illustration of the rotary kiln of FIG. 1 illustrating the introduction of port air into the rotary kiln near its infeed end.
Figure 3:
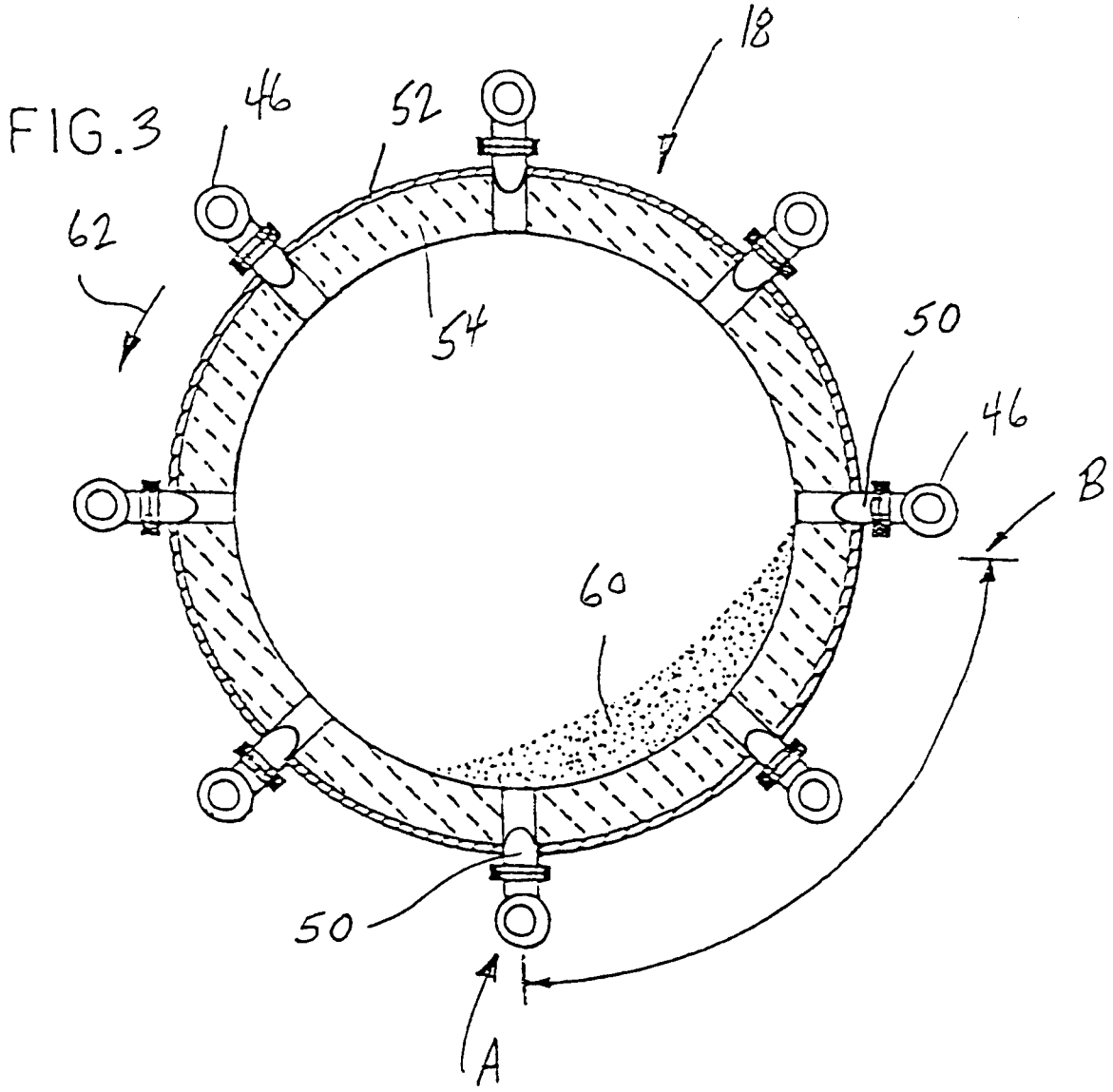
FIG. 3 is a cross-section view through the rotary kiln illustrating the introduction of port air beneath the bed of feed stock with the refractory material lining the interior of the kiln schematically illustrated.

Referring now to FIGS. 2 and 3, port air is introduced near an infeed end 36 of the rotary kiln 18 by the port air fan 26. In the embodiment of the invention shown, the port air is introduced near the infeed end 36 of the rotary kiln 18 in a first port air zone 28 and the second port air zone 30. Each of the first and second port air zones 28 and 30 include a main air manifold 38 that extends around the outer circumference of the rotary kiln 18. Each of the manifolds 38 receives the supply of air from the port air fan 26 through an air passageway 40. The flow of air to each of the first and second port air zones 28 and 30 are controlled by a control damper 42 positioned in the air passageway 40 between the port air fan 26 and the respective air manifold 38. Each air flow control damper 42 is controlled by a damper actuator which controls the amount of air entering into the respective air zone 28 or 30 based upon a signal from a flow meter 44 positioned between the control damper 42 and the respective manifold 38. The combination of the two air flow control dampers 42 allows differing amounts of port air to be supplied to the two port air zones 28 and 30.

Each of the port air zones 28 and 30 includes a series of port air conduits 46 spaced around the outer circumference of the rotary kiln 18. Each of the port air conduits 46 extends parallel to the longitudinal length of the rotary kiln 18 and is coupled to the manifold 38 such that air from the port air fan 26 can flow through the air passageway 40, through the manifold 38, and into the port air conduits 46. In the preferred embodiment of the invention, either eight or twelve individual port air conduits 46 can be spaced around the outer circumference of the rotary kiln 18.

Each of the port air conduits 46 includes a tipper valve 48 and a plurality of ports 50 that extend from the port air conduit 46 into the interior of the rotary kiln 18, as best shown in FIG. 3. As can be seen in FIG. 3, each port 50 extends through an outer shell 52 of the rotary kiln 18.

Referring back to FIG. 2, each of the port air conduits 46 includes three ports 50 spaced along the length of the conduit 46 that each extend into the interior of the rotary kiln 18. The supply of air flowing through the port air conduit 46 is controlled by an inlet valve, such as a conventional tipper valve 48. The tipper valve 48 is a specialized mechanism that contacts a fixed tipper mechanism (not shown) to open and close the tipper valve 48 as the rotary kiln 18 rotates about its longitudinal axis.

Referring again to FIG. 3, in the preferred embodiment of the invention the tipper valve 48 for each of the port air conduits 46 is configured to open when each of the ports 50 for the port air conduit 46 is beneath the bed 60 of pelletized agglomerate feed stock contained within the rotary kiln 18. As the rotary kiln 18 rotates in the direction shown by arrow 62, the tipper valve 48 for each port air conduit 46 opens at the location indicated by reference character A. At the location indicated by reference character A, the port 50 is beneath the bed 60 of pelletized agglomerate feed stock. As the rotary kiln 18 continues to rotate in the direction shown by arrow 62, a second tipper mechanism closes the tipper valve 48 for the port air conduit 46 when the port air conduit 46 reaches the location indicated by reference character B. In the preferred embodiment of the invention, the tipper valve 48 opens at approximately 180° and closes at approximately 270° when measured in a counter-clockwise direction, as indicated by the reference characters A and B in FIG. 3. In this manner, port air flows into the open interior of the rotary kiln 18 only when each of the ports 50 is beneath the bed 60 of pelletized agglomerate feed stock.

Although the supply of port air is shown as being introduced in two separate port air zones in the preferred embodiment of the invention, it should be understood that a single port air zone that extends the combined length of the first port air zone 28 and second port air zone 30 shown in FIG. 2 could also be used. The pair of port air zones 28 and 30 shown in FIG. 2 are necessitated by the kiln riding ring 51 positioned between the pair of port air zones. In either case, it is important that the supply of port air be introduced beneath the bed of pelletized agglomerate feed stock near the infeed end 36 of the rotary kiln 18.

The port air introduced into both the first port air zone 28 and the second port air zone 30 allows the pelletized agglomerate feed stock entering into the infeed end 36 of the rotary kiln 18 to more efficiently burn the material fuel contained in the pelletized agglomerate feed stock in the parallel flow (co-current) rotary kiln 18. The burning efficiency of the volatile combustibles and fixed carbon in the pelletized agglomerate feed stock is greatly enhanced by strategically introducing the supply of port air from the port air fan 26 into the material bed 60 near the infeed end 36 of the rotary kiln 18. In addition to burning out the fixed carbon in the pelletized agglomerate, the introduction of port air beneath the material bed significantly lowers the external fuel consumption through the burner 20 and increases the ability to achieve some degree of glassifying (vitrification) of the agglomerate which produces in improved product quality.

The amount of port air introduced by the port air fan 26 is selected to accomplish the burning of most of the volatile combustible matter and fixed carbon in the bed 60 of pelletized agglomerate feed stock and to control the bed and gas temperatures. The quantity of port air introduced into each of the port air zones 28 and 30 that is required to bum the volatile combustibles and most of the carbon is in the range of 14–17 SCF of air per pound of dry feed stock. The overall quantity of port air introduced, excluding any lance air introduced through the air lance 22, required for combustion and to control the bed and gas temperature is in the range of 20–26 SCF of air per pound of dry feed material. If the overall material fuel (fixed carbon) in the pelletized agglomerate feed stock increases, the quantity of air needs to be increased to burn the increased material fuel and control the bed and gas temperatures.

In the rotary kiln 18, the burner 20 at the infeed end 36 provides the initial heating and ignition source. As the pelletized agglomerate feed stock enters into the infeed end 36, the burner 20 initially dries the material and causes the burnable, combustible matter to volatize. The port air is introduced into the material bed as the material is being heated near the infeed end 36 by the burner 20. Initially, the port air flows through the bed of material with the volatizing combustible matter and burns exiting the bed. The port air and a small amount of lance air supplied through the air lance 22 provide the combustion air needed to complete the burning of the combustible material above the material bed. The material fuel in the feed stock begins to burn in the material bed as the material temperature rises. The port air then provides the oxygen required to burn the fixed carbon in the feed stock as the bed temperatures approach 1650° F.

The introduction of port air beneath the bed of pelletized agglomerate feed stock in both the first port air zone 28 and the second port air zone 30 act as quasi-burners that burn the combustible material fuel contained in the pelletized agglomerate in the material bed 60. The burning of the combustible material in the bed 60 allows the amount of fuel fed to the burner 20 to be decreased while still transforming the pelletized agglomerate into the same lightweight aggregate at the discharge end 64 of the rotary kiln 18.

When the rotary kiln 18, including the first port air zone 28 and the second port air zone 30, is operated with the optimum flow of port air, the lightweight aggregate produced will be a strong, lightweight, glassy product with a low bulk specific gravity (SSD) and water absorption number. The introduction of port air beneath the bed of material will also result in a lower burner 20 firing rate.

In the preferred embodiment of the invention, the estimated air flow required for combustion of the material fuel in the feed stock is approximately 4800 SCFM and the total air flow for combustion and controlling solids and gas temperature is approximately 7500 SCFM. In the preferred embodiment of the invention, 33% of the port air flows through the first port air zone 28, while 67% of the port air enters into the second port air zone 30. For example, the actual flow of air through the first port air zone 28 is approximately 2000–2500 SCFM while the flow of air through the second port air zone 30 is approximately 3000–5000 SCFM. It should be understood, however, that the actual air flow requirements to the ports will vary depending upon the material fuel content of the pelletized aggregate feed stock fed into the infeed end 36 of the rotary kiln 18.

The lightweight aggregate material leaving the rotary kiln 18 at its discharge end 64 is fed to the cooler 32 where the product temperature is reduced such that the lightweight aggregate can be handled using conventional material handling techniques. The kiln off-gases are vented to atmospheric pollution control equipment 66, and eventually discharged through the gas stack 34.

Figure 4:
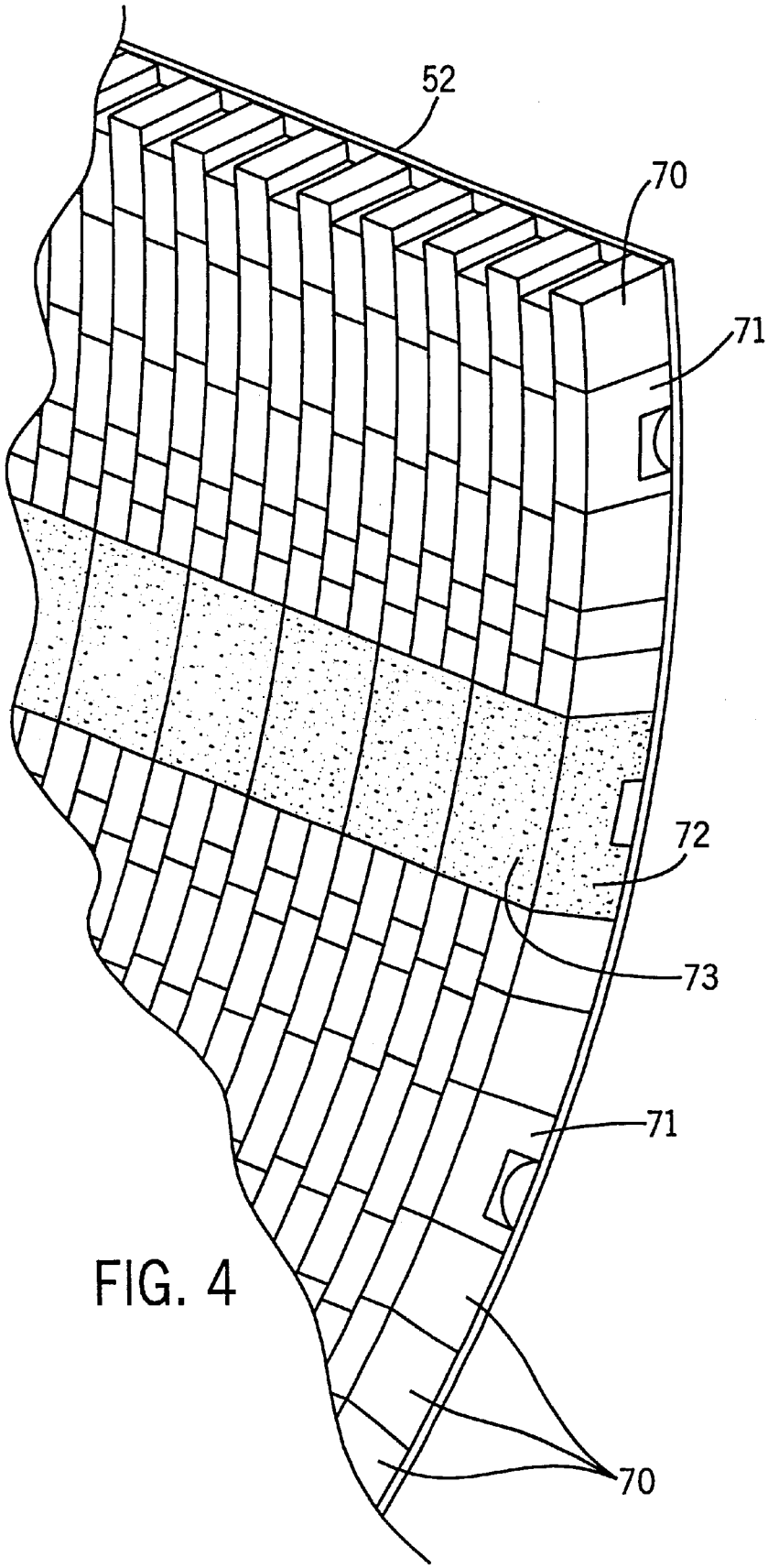
FIG. 4 is an enlarged fragmentary perspective view of rows of refractory bricks both of the conventional type and of the new specially shaped refractory channel port (RCP) type lining the interior of the rotary kiln as well as a row of key blocks for holding the refractory bricks in place.

Referring now to FIG. 4, there is illustrated a portion of the refractory material lining the interior of rotary kiln 18. The refractory material includes a plurality of bricks composed of a refractory material which are disposed longitudinally and circumferentially adjacent one another. The bricks are formed in longitudinal rows extending parallel to the axis of kiln 18, and are either of the conventional type traditionally used in kilns, such as that designed by the numeral 70, or are of the new design of the present invention, designated by numeral 71, and referred to herein as refractory channel port (RCP) bricks. In one embodiment, there are six rows of conventional bricks 70 for each row of RCP bricks 71. This results in a total of twelve rows of the RCP bricks 71 disposed about the interior or inner surface of the shell 52 of kiln 18. However, as previously noted herein, any combination of rows of conventional bricks 70 and RCP bricks 71 may be employed depending upon the end use for kiln 18. It should be noted that the bricks 70 and 71 are disposed in a staggered arrangement which results in a pattern providing a more stable lining as kiln 18 rotates. FIG. 4 also illustrates a row of key blocks 72. Each block 72 includes a top face 73 which is flush with the top faces of bricks 70 and 71. Blocks 72 also include a bottom face (see FIGS. 12–14) which abuts against the inner surface of shell 52. The blocks 72 are welded to shell 52, as will hereinafter be described, and thus prevent bricks 70 and 71, which are not fixed in any manner to shell 52, from rotating within shell 52 as kiln 18 rotates. Since bricks 70 and 71 are not attached to shell 52, key blocks 72 thus maintain alignment of bricks 71 with the ports of the air delivery system hereinafter to be described.

Figure 5:
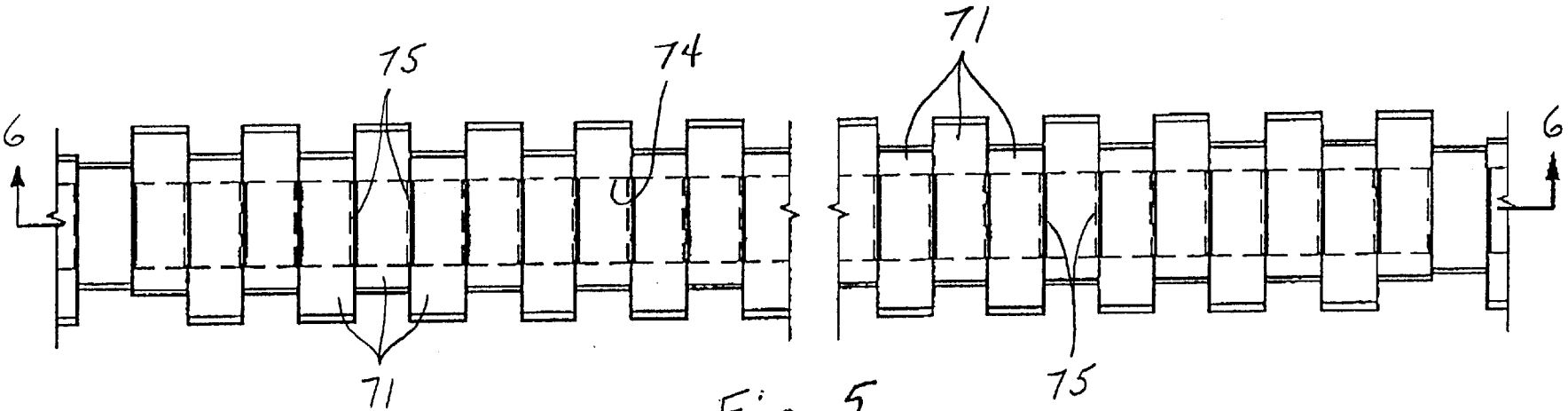
FIG. 5 is a top view of an assembled row of RCP bricks.

FIG. 5 illustrates a top view of an assembled row of RCP bricks 71. By removal of adjacent rows of conventional bricks 70, the staggered arrangement for bricks 71 is clearly demonstrated. It should also be noted that the horizontally dashed lines in FIG. 5 illustrate a main air conveying channel 74 formed in bricks 71 while the vertically extending dashed lines illustrate a plurality of air vent channels 75 disposed between each adjacent brick 71, both of which will hereinafter be described in more detail.

Figure 6:
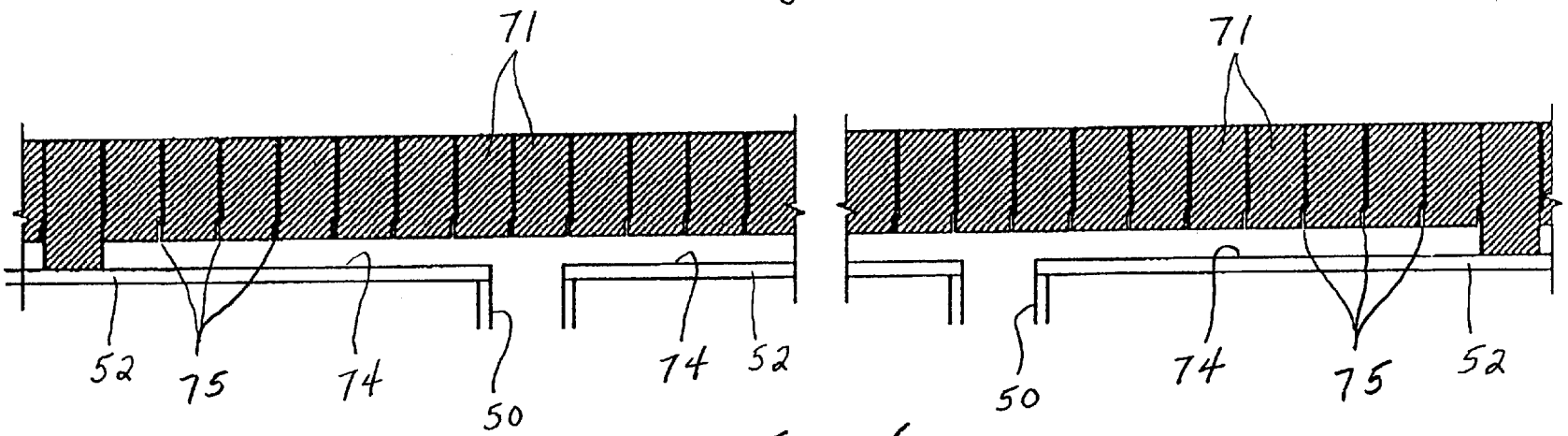
FIG. 6 is a section view taken through an air inlet into the rotary kiln taken along the line 6—6 in FIG. 5.

FIG. 6 is a section view taken through the middle of the row of bricks 71 illustrated in FIG. 5. FIG. 6 illustrates in more detail that the main air conveying channel 74 is disposed along the inner surface of shell 52 to extend longitudinally and parallel to the axis of shell 52. Main air conveying channel 74 communicates with the air inlet ports 50 as well as with the air vent channels 75. The air vent channels 75 communicate between the main air conveying channel 74 and extend through bricks 71 into the interior chamber of shell 52, as will hereinafter be described in more detail.

Figure 7:
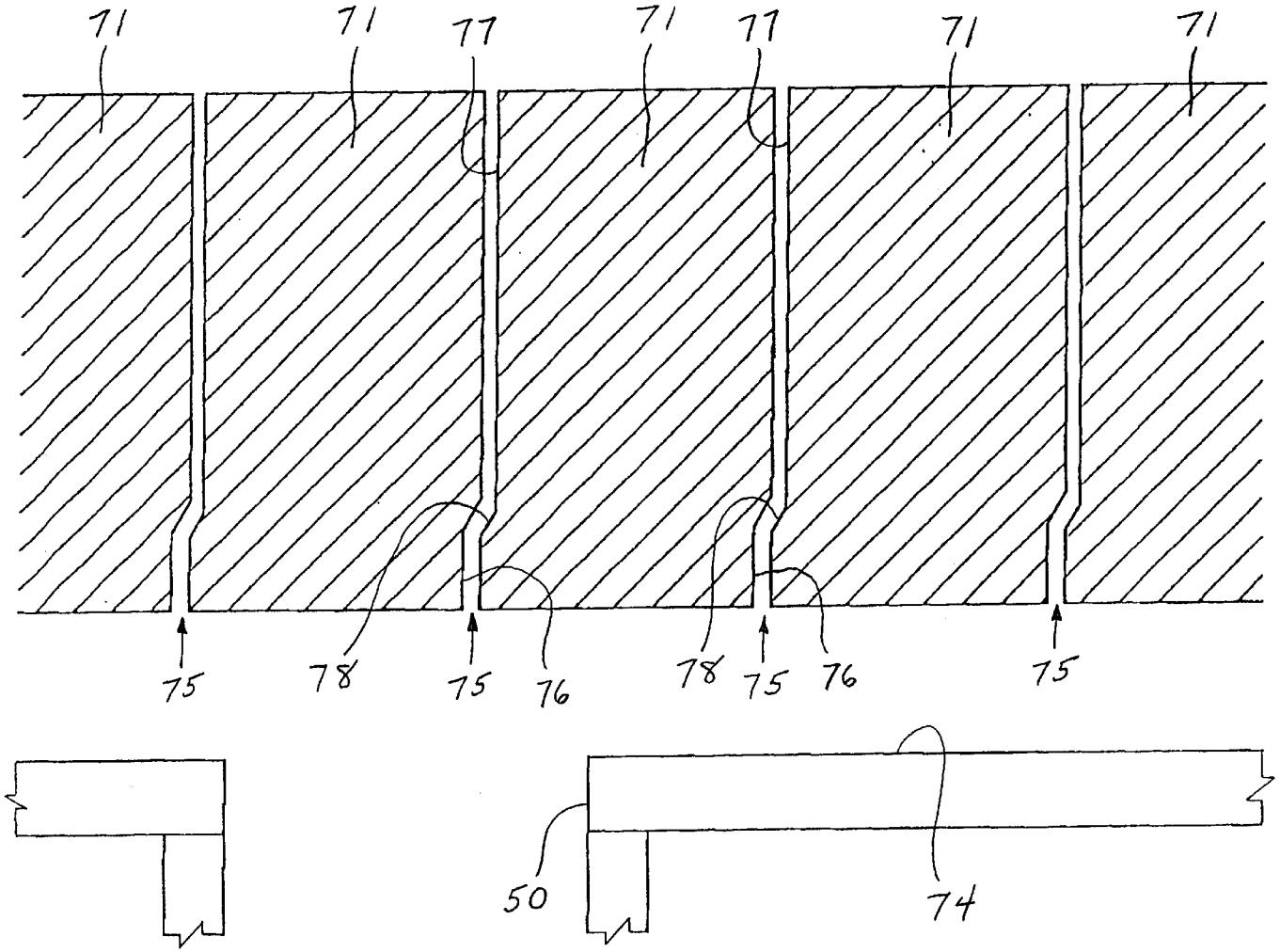
FIG. 7 is an enlarged cross-sectional view of an assembled row of RCP bricks.

FIG. 7 illustrates an enlarged cross-sectional view of an assembled row of RCP bricks 71. FIG. 7 illustrates in more detail that air vent channels 75 are formed between each adjacent brick 71 and each vent channel 75 has a double dogleg configuration. Also, it should be noted that the bottom or lower portion 76 of each channel 75 is wider than the top or upper portion 77 of channels 75. Central portion 78 of each channel 75 is angled with respect to portions 76 and 77, and interconnects portions 76 and 77. As illustrated, the longitudinal axis of upper portion 76 is offset from the longitudinal axis of lower portion 77 which provides the double dogleg configuration illustrated.

Figure 8B:
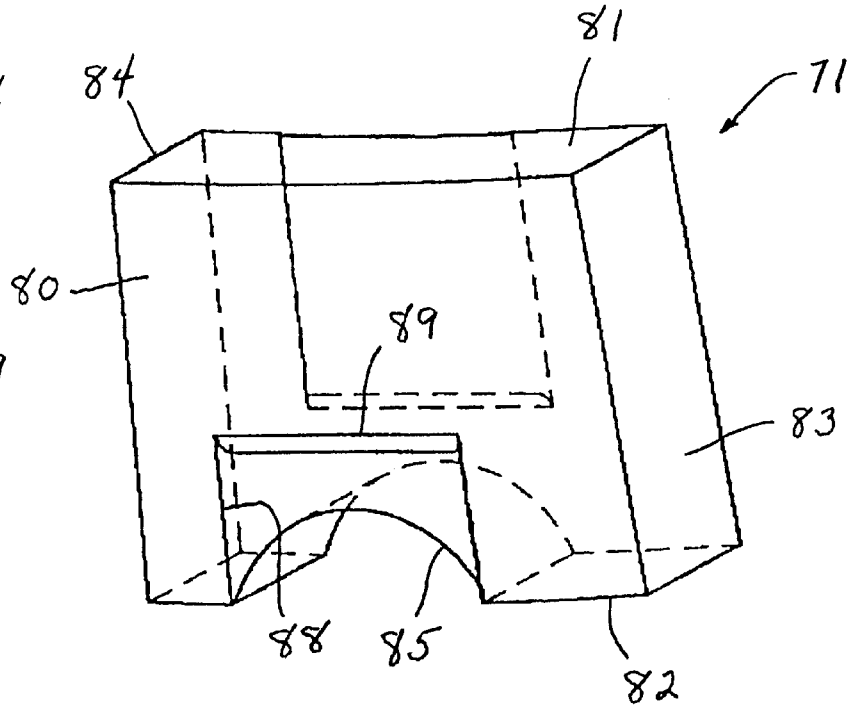
FIG. 8*b* is a perspective view of an RCP brick illustrating its rear face.
Figure 8A:
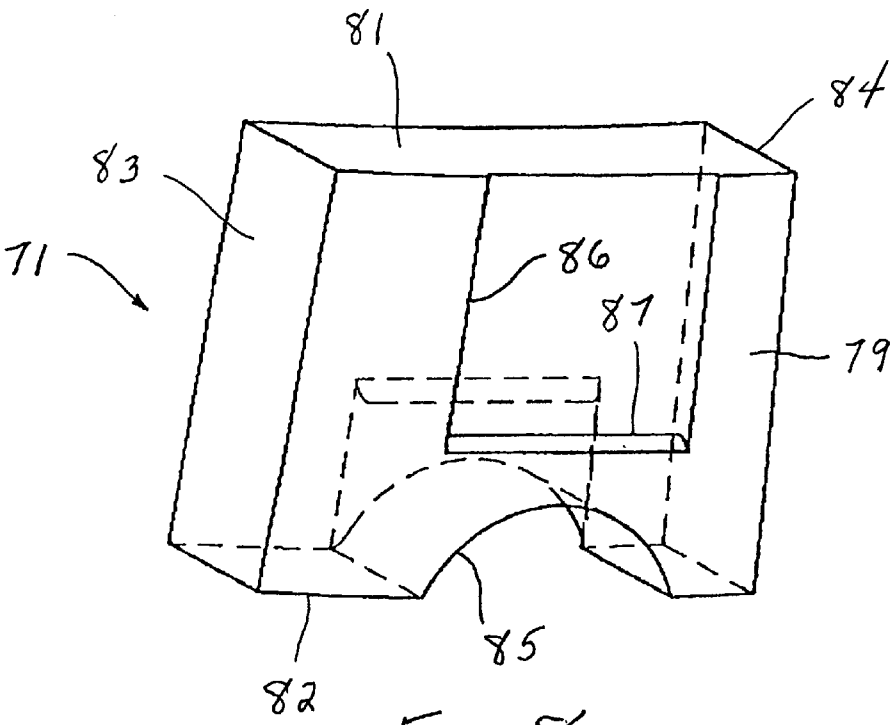
FIG. 8*a* is a perspective view of an RCP brick illustrating its front face.

FIGS. 8*a* and 8*b* are perspective views of one RCP brick 71 illustrating front and rear views respectively. Each brick 71 includes a front face 79, a rear face 80, a top face 81, a bottom face 82, and opposite end faces 83 and 84. A main air opening 85 is formed in the bottom face 82 of brick 71 and extends from the front face 79 to the rear face 80 thereof. Main air opening 85 is substantially U-shaped in cross section, although other cross-sectional shapes may also be employed. In order to form air vent channels 75, each brick 71 includes a top air vent passage 86 formed as a recess in the front face 79 of brick 71. Top air vent passage 86 extends downwardly from top face 81 to a lower end 87 located between top face 81 and bottom face 82. Preferably, lower end 87 is located slightly above air opening 85, as shown best in FIG. 8*a*. Lower end 87 is comprised of a bevel surface which is about 15°–45°, preferably 30°, from vertical, as shown best in FIG. 11. Also, as shown best in FIG. 10, the edges of air vent passage 86 are rounded or radiused to minimize stress. Preferably, the air vent passage 86 is formed as a rectangular recess in front face 79, and as shown best in FIG. 11, it preferably is recessed approximately 0.19 inches from the plane defined by front face 79. It should be noted that the depth of passage 86 is dependent on kiln feed material being processed.

Figure 10:
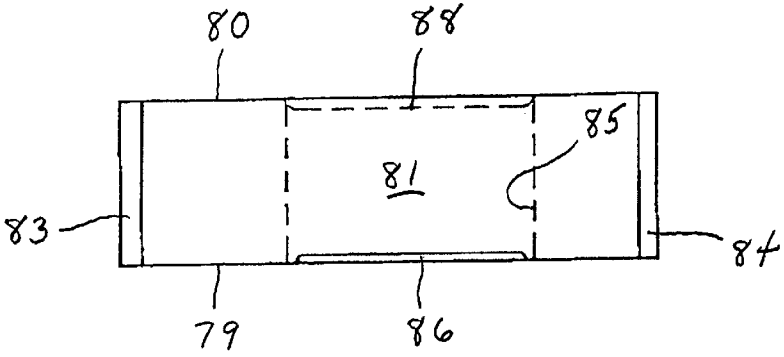
FIG. 10 is a top view of the RCP brick of FIG. 8.
Figure 11:
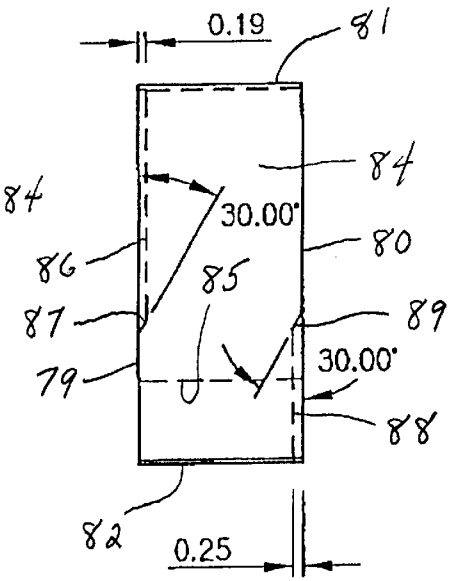
FIG. 11 is an end view of the RCP brick of FIG. 8.

Referring now to FIG. 8*b*, there is illustrated a bottom air vent passage 88 formed as a recess in the rear face 80 of each brick 71. Bottom air vent passage 88 extends upwardly from bottom face 82 toward upper end 89 located between bottom face 82 and top face 81. As illustrated best in FIG. 11, upper end 89 is formed as a beveled surface of about 15°–45°, preferably 30°, from vertical. As illustrated best in FIG. 8*b*, bottom air vent passage 88 is formed as a rectangular-shaped recess in rear face 80, and as illustrated in FIG. 10, its side edges are rounded or radiused to minimize stress. FIG. 11 illustrates that bottom air vent passage 88 is recessed from the plane defined by rear face 80 of brick 71 about 0.25 inches and is thus slightly deeper than top air vent passage 86. The depth of passage 88, like that for passage 86, is dependent on the kiln feed material being processed. Thus, when assembled, lower portion 76 of air vent channel 75 will be slightly wider than upper portion 77 as illustrated in FIG. 7. Also, it is important to note that the lower end 87 of top air vent passage 86 extends below the upper end 89 of bottom air vent passage 88, as seen best in FIG. 11. In other words, lower end 87 meets or merges with front face 79 about 6 inches below top face 81 whereas upper end 89 meets or merges with rear face 80 about 5.5 inches below top face 81. As a result, when assembled, the angled central portion 78 of air vent channel 75 is formed, as illustrated in FIG. 7.

Figure 9:
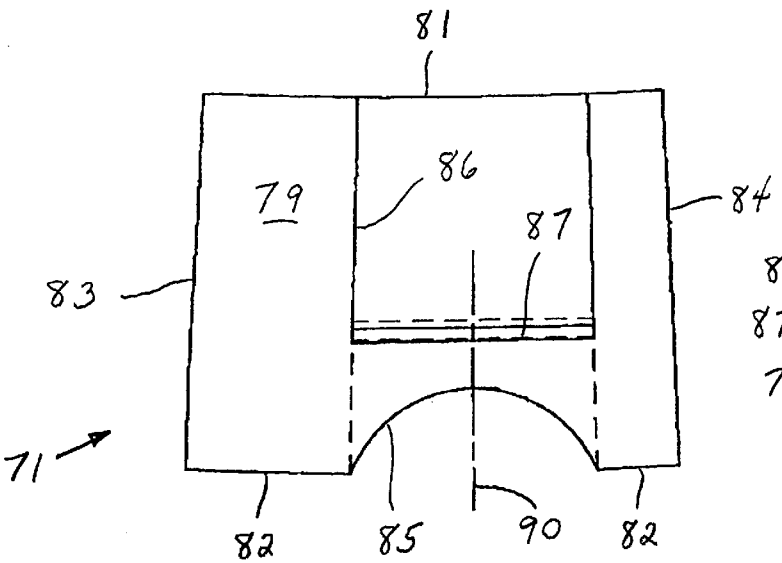
FIG. 9 is a side elevation of the RCP brick of FIG. 8.

Thus, when one brick 71 is positioned so that its front face 79 abuts against the rear face 80 of an adjacent brick 71, the main air openings 85 of each brick 71 are aligned to form the main air conveying channel 74. In addition, the top vent passage 86 of one brick is aligned with the bottom air vent passage 88 of an adjacent brick to form the desired air vent channel 75 into the interior of the kiln 18, as best illustrated in FIG. 7. Finally, it should be noted that main air opening 85 is aligned vertically (see line 90 in FIG. 9) with top air vent passage 86 and bottom air vent passage 88 with each having approximately the same width. However, main air opening 85, top air vent passage 86 and bottom air vent passage 88 are also offset with respect to a vertical line running through the center of brick 71. This is necessary since the bricks 71 are assembled in a staggered arrangement shown best in FIG. 5. In other words, if brick 71 is 12 inches in width, line 90 is located 7 inches from end face 84 and 5 inches from end face 83.

Figure 13:
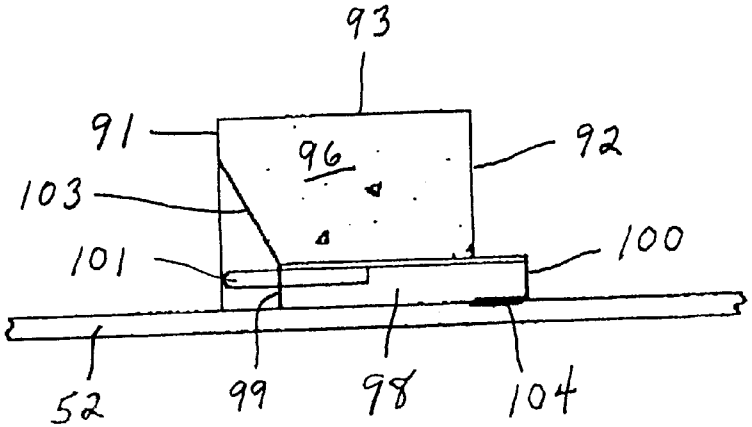
FIG. 13 is a section view of the key block of FIG. 12.
Figure 12:
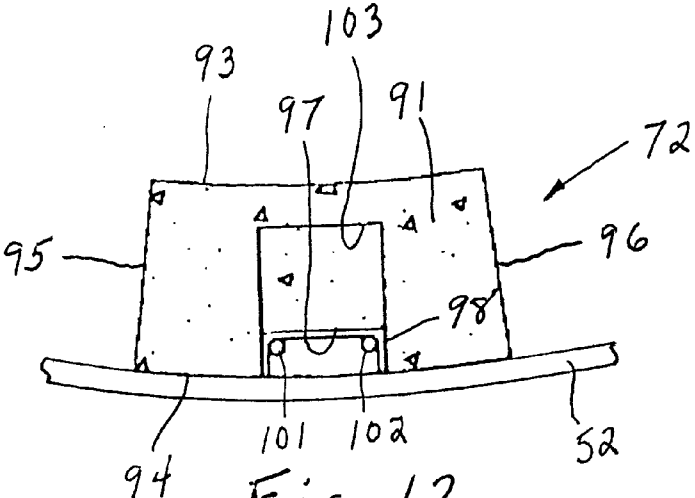
FIG. 12 is an end elevation of a key block.
Figure 14:
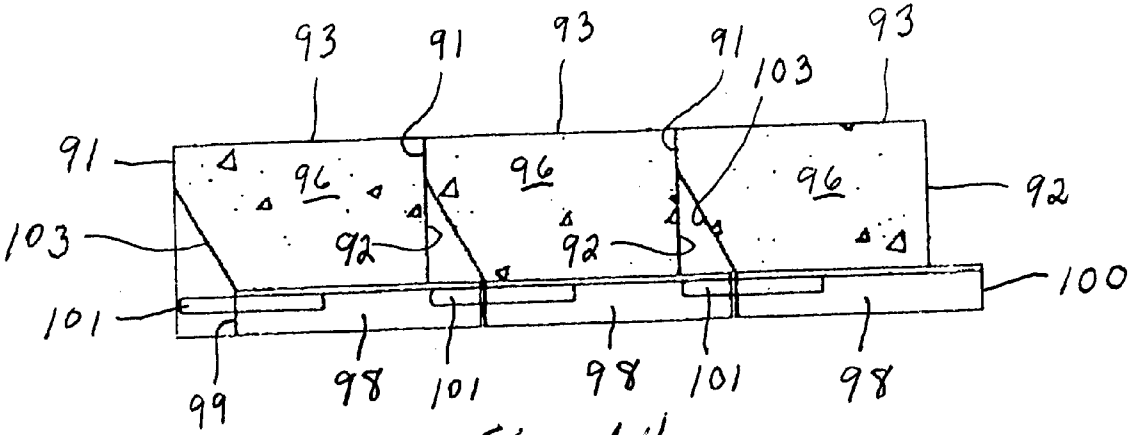
FIG. 14 is a side view illustrating three key blocks assembled in a row.

Referring now to FIGS. 12–14, the key blocks 72 previously referred to in connection with FIG. 4 are illustrated in more detail. Key blocks 72 are attached to kiln shell 52 to prevent the refractory bricks 71 from rotating within shell 52. These key blocks 72 thus maintain alignment of the air inlet ports 50 with the main air conveying channel 74 formed in bricks 71. More specifically, each key block 72 includes a front face 91, a rear face 92, a top face 93, a bottom face 94, and opposite side faces 95 and 96. As shown best in FIG. 12, bottom face 94 abuts against the inner surface of shell 52, and as best illustrated in FIG. 4, top face 93 is flush with top faces 81 of bricks 71. Each key block 72 is composed of a castable type refractory material suitable for service duty similar to that of bricks 71. A channel-shaped opening 97 is formed inwardly from bottom face 94 and extends through block 72 from front face 91 to rear face 92, when the castable refractory material is formed around and anchored to a C-shaped steel channel 98 therein. As shown best in FIG. 12, the legs of steel channel 98 are flush with bottom face 94 of block 72. However, as shown best in FIG. 13, front end 99 of steel channel 98 is recessed inwardly from front face 91 whereas the rear end 100 of steel channel 98 projects outwardly from rear face 92 of block 72. A pair of spaced pins 101 and 102 are welded to the interior of steel channel 98, and as best shown in FIG. 13, project outwardly from front end 99 so as to be flush with front face 91 of block 72. A recess 103 in front face 91 accommodates the projecting end of pins 101 and 102.

In order to assemble blocks 72 as shown in FIG. 14, a 2 inch long piece of steel channel (not shown) is welded to the inner surface of shell 52. A first block is then positioned with pins 101 and 102 secured underneath this 2 inch long piece of steel channel. The first block is welded as at 104 to the inner surface of shell 52. Thereafter, a second block is positioned behind first block so that its front face 91 abuts against the rear face 92 of the block 72 which has been welded to shell 52. This second block 72 is then also welded to shell 52. It should be noted that pins 101 and 102 on the second block are used to properly align the second block with respect to the first block since the projecting ends of pins 101 and 102 are received within the rear end 100 of the steel channel 98 of the first block 72. The above procedure is repeated until an entire row of key blocks 72 are assembled within shell 52, as shown best in FIG. 4.

What is claimed is:

1. A refractory brick for a rotary kiln, comprising:

a brick composed of refractory material, said brick having a front face, a rear face, a top face, a bottom face, and opposite end faces;

a main air opening formed in said bottom face and extending from said front face to said rear face;

a top air vent passage formed in said front face and extending downwardly from said top face to a lower end located between said top face and said bottom face; and a bottom air vent passage formed in said rear face and extending upwardly from said bottom face to an upper end located between said bottom face and said top face.

2. The refractory brick of claim 1 wherein said main air opening is substantially U-shaped in cross section.

3. The refractory brick of claim 1 wherein the lower end of said top vent channel is a beveled surface.

4. The refractory brick of claim 3 wherein said beveled surface is about 15° to 45° from vertical.

5. The refractory brick of claim 1 wherein the upper end of said bottom vent channel is a beveled surface.

6. The refractory brick of claim 5 wherein said beveled surface is about 15° to 45° from vertical.

7. The refractory brick of claim 1 wherein the lower end of said top air vent passage is below the upper end of said bottom air vent passage.

8. The refractory brick of claim 7 wherein the bottom air vent passage is recessed in said rear face deeper than the top air vent passage is recessed in said front face.

9. The refractory brick of claim 1 wherein said main air opening, said top air vent passage and said bottom air vent passage all have the same widths, said widths being less than the width of said brick.

10. The refractory brick of claim 9 wherein said main air opening, said top air vent passage and said bottom air vent passage are all vertically aligned.

11. A refractory brick subassembly for a rotary kiln, comprising:

first and second bricks, each brick composed of a refractory material, each brick having a front face, a rear face, a top face, a bottom face, and opposite end faces;

each of said first and second bricks further including a main air opening formed in the bottom face of each brick and extending from the front face to the rear face thereof;

each of said first and second bricks further including a top air vent passage formed in the front face of each brick and extending downwardly from the top face to a lower end located between the top face and bottom face thereof;

each of said first and second bricks further including a bottom air vent passage formed in the rear face of each brick and extending upwardly from the bottom face to an upper end located between the bottom face and top face thereof;

said second brick positioned so that its front face abuts against the rear face of said first brick to align the main air openings of said first and second bricks and so that its top air vent passage and the bottom air vent passage of said first brick align to form an air vent channel communicating between said aligned main air openings and the top faces of said first and second bricks.

12. The refractory brick of claim 11 wherein said main air openings are substantially U-shaped in cross section.

13. The refractory brick of claim 11 wherein the lower end of said top vent passage is a beveled surface.

14. The refractory brick of claim 13 wherein said beveled surface is about 15° to 45° from vertical.

15. The refractory brick of claim 11 wherein the upper end of said bottom vent passage is a beveled surface.

16. The refractory brick of claim 15 wherein said beveled surface is about 15° to 45° from vertical.

17. The refractory brick of claim 11 wherein the lower end of said top air vent passage extends below the upper end of said bottom air vent passage.

18. The refractory brick of claim 17 wherein the bottom air vent passage is recessed in said rear face deeper than the top air vent passage is recessed in said front face.

19. The refractory brick of claim 11 wherein said main air opening, said top air vent passage and said bottom air vent passage all have the same widths, said widths being less than the width of said brick.

20. A rotary kiln, comprising:

a cylindrically-shaped shell having an interior chamber, an inner surface and an outer surface, and defining a longitudinal axis about which said shell is adapted to rotate;

a refractory material lining the inner surface of said shell, said refractory material comprises a plurality of bricks disposed longitudinally and circumferentially adjacent one another; and an air conveying system for delivering air to the interior chamber of said shell, said air conveying system comprising an air inlet port disposed in said shell, a main air conveying channel communicating with said air inlet port and formed in said refractory material to extend longitudinally and parallel to the axis of said shell, and at least one air vent channel communicating with said main air conveying channel and extending through said refractory material into the interior chamber of said shell, said air conveying system includes a plurality of air vent channels spaced longitudinally along said main air conveying channel, and each of said air vent channels extends through adjacent bricks of said refractory material, and said air vent channels are formed between adjacent bricks of said refractory material.

21. The rotary kiln of claim 20 wherein said main air conveying channel extends along and adjacent to the inner surface of said shell.

22. The rotary kiln of claim 20 wherein said air conveying system includes a plurality of air vent channels spaced longitudinally along said main air conveying channel.

23. A rotary kiln, comprising:

a cylindrically-shaped shell having an interior chamber, an inner surface and an outer surface, and defining a longitudinal axis about which said shell is adapted to rotate;

a refractory material lining the inner surface of said shell, an air conveying system for delivering air to the interior chamber of said shell, said air conveying system comprising an air inlet port disposed in said shell, a main air conveying channel communicating with said air inlet port and formed in said refractory material to extend longitudinally and parallel to the axis of said shell, and at least one air vent channel communicating with said main air conveying channel and extending through said refractory material into the interior chamber of said shell, said at least one air vent channel includes a top vent portion communicating with said interior chamber, a bottom vent portion communicating with said main air conveying channel, and a center vent portion communicating between said top and bottom vent portions, said top vent portion longitudinally spaced with respect to said bottom vent portion so that said top vent portion is offset from said bottom vent portion.

* * * * *

UNITED STATES PATENT AND TRADEMARK OFFICE

CERTIFICATE OF CORRECTION

PATENT NO. : 6,309,211 B1
DATED : October 30, 2001
INVENTOR(S) : Neil R. Dock et al.

It is certified that error appears in the above-identified patent and that said Letters Patent is hereby corrected as shown below:

Title page,
Item [73] Assignee, please delete the Assignee name "Suedala" and replace with
-- Svedala --

Signed and Sealed this

Nineteenth Day of March, 2002

*Attest:*

*Attesting Officer*

JAMES E. ROGAN
*Director of the United States Patent and Trademark Office*